US007958871B2

(12) United States Patent
Koenigsegg

(10) Patent No.: US 7,958,871 B2
(45) Date of Patent: Jun. 14, 2011

(54) COMBUSTION AIR SUPPLY ARRANGEMENT

(75) Inventor: Christian V. Koenigsegg, Ovanvägen (SE)

(73) Assignee: Koenigsegg Automotive AB, Vejbystrand (SE)

( * ) Notice: Subject to any disclaimer, the term of this patent is extended or adjusted under 35 U.S.C. 154(b) by 791 days.

(21) Appl. No.: 11/792,227

(22) PCT Filed: Dec. 2, 2005

(86) PCT No.: PCT/SE2005/001818

§ 371 (c)(1), (2), (4) Date: Nov. 23, 2007

(87) PCT Pub. No.: WO2006/059950

PCT Pub. Date: Jun. 8, 2006

(65) Prior Publication Data

US 2008/0127939 A1 Jun. 5, 2008

(30) Foreign Application Priority Data

Dec. 3, 2004 (SE) ..... 0402952

(51) Int. Cl.
*F02B 33/00* (2006.01)
*F02B 33/44* (2006.01)

(52) U.S. Cl. ..... 123/559.1; 123/564; 123/563

(58) Field of Classification Search ..... 123/559.1–564, 123/1 A, 65 BA; *F02B 33/44*
See application file for complete search history.

(56) References Cited

U.S. PATENT DOCUMENTS

| | | | | |
|---|---|---|---|---|
| 4,062,333 | A | 12/1977 | Matsuda et al. | 123/119 C |
| 4,730,593 | A | 3/1988 | Regar | 123/561 |
| 4,815,437 | A * | 3/1989 | Regar | 123/564 |
| 4,995,347 | A * | 2/1991 | Tate et al. | 123/65 BA |
| 5,064,423 | A * | 11/1991 | Lorenz et al. | 60/611 |
| 5,119,795 | A * | 6/1992 | Goto et al. | 123/563 |
| 5,121,733 | A * | 6/1992 | Goto et al. | 123/559.1 |
| 5,190,016 | A | 3/1993 | Takeda | 123/564 |
| 5,429,100 | A * | 7/1995 | Goto et al. | 123/559.1 |
| 5,477,839 | A | 12/1995 | Oshima et al. | 123/563 |
| 6,684,863 | B2 * | 2/2004 | Dixon et al. | 123/559.1 |
| 7,100,584 | B1 * | 9/2006 | Bruestle et al. | 123/563 |
| 7,404,293 | B2 * | 7/2008 | Ozawa | 123/563 |
| 2007/0051349 | A1 * | 3/2007 | Marumoto et al. | 123/559.1 |
| 2010/0314186 | A1 * | 12/2010 | Ma | 180/165 |

FOREIGN PATENT DOCUMENTS

| | | | | |
|---|---|---|---|---|
| JP | 61149521 | A * | 7/1986 | |
| JP | 62271933 | A * | 11/1987 | |
| JP | 63297728 | A * | 12/1988 | |
| JP | 1-92524 | | 4/1989 | |
| JP | 05133235 | A * | 5/1993 | |
| JP | 05263701 | A * | 10/1993 | 123/559.1 |
| JP | 08260991 | A * | 10/1996 | |
| WO | WO 9323660 | A1 * | 11/1993 | |

* cited by examiner

*Primary Examiner* — Thai Ba Trieu
(74) *Attorney, Agent, or Firm* — Young & Thompson

(57) ABSTRACT

The invention relates to a combustion air supply arrangement, including an air intake duct of an internal combustion engine, and a compressor arranged in the air intake duct, and a first throttle located downstream the compressor and upstream the internal combustion engine and arranged to change the flow area of the air intake duct between the compressor and the internal combustion engine, the same furthermore including a second throttle, which is located upstream the compressor and which is arranged to change the flow area of the air intake duct upstream the compressor. Furthermore, the compressor is a centrifugal compressor, the rotational speed of which is directly dependent on the rotational speed of the internal combustion engine, and that the combustion air supply arrangement is arranged in such a way that the sucked-in air is compressed once between the second throttle and the internal combustion engine.

10 Claims, 2 Drawing Sheets

COMBUSTION AIR SUPPLY ARRANGEMENT

TECHNICAL FIELD OF THE INVENTION

Figure 1:
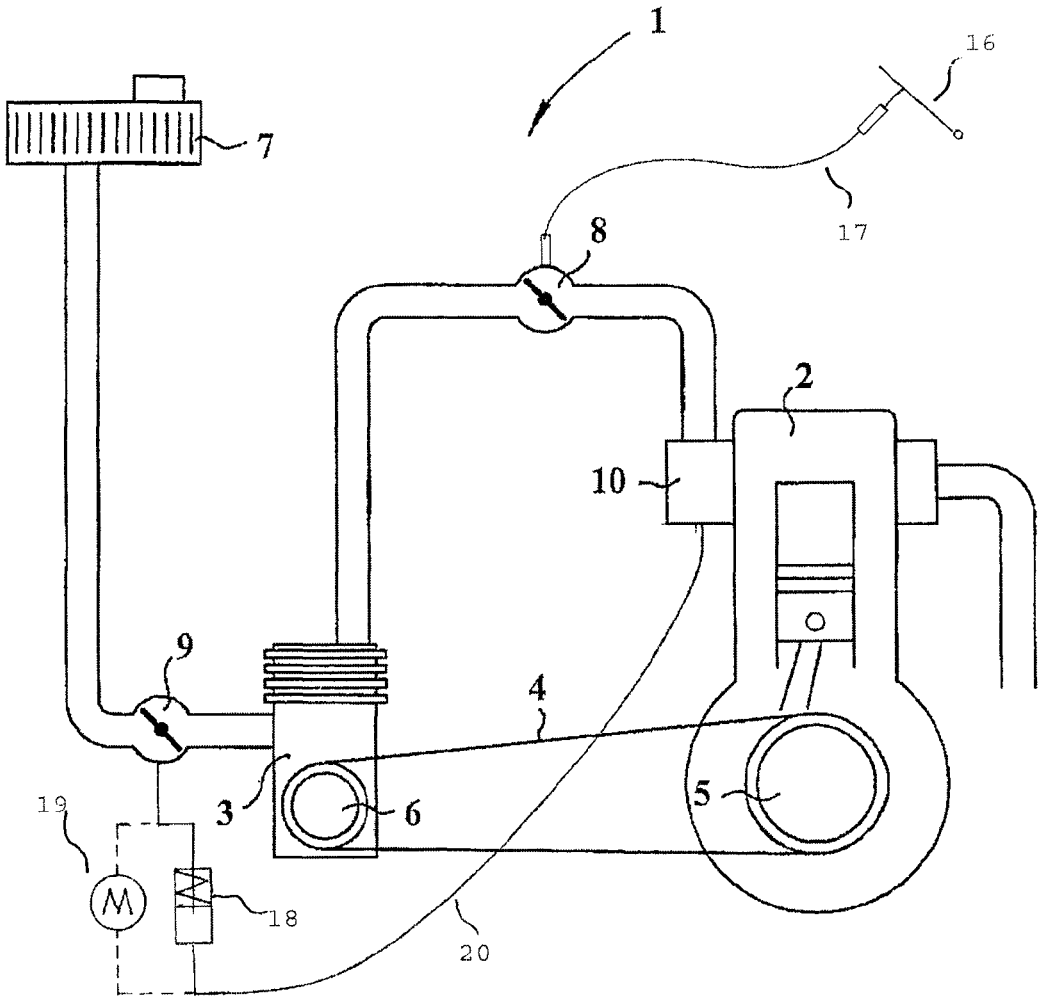

This invention relates to a combustion air supply arrangement, comprising an air intake duct of an internal combustion engine, and a compressor arranged in the air intake duct, and a first throttle located downstream the compressor and upstream the internal combustion engine and having the purpose of changing the flow area of the air intake duct between the compressor and the internal combustion engine, the same furthermore comprising a second throttle, which is located upstream the compressor and which is arranged to change the flow area of the air intake duct upstream the compressor.

The throttle has the purpose of shutting off the air supply to the engine when the accelerator control is disengaged, for instance in connection with the change of gearing from the engine. Already here it should be pointed out that by throttle, herein reference is made to all types of valves, air chokes and throttle valves that regulate the throughput of air in a duct and should accordingly be interpreted in the widest sense thereof.

BACKGROUND OF THE INVENTION AND PRIOR ART

The present invention has the background thereof in the need to shut off the air supply to an engine when, for instance, the gearing from the same is to be changed. Air intake ducts for internal combustion engines generally comprise a compressor, which is intended to provide a desired positive pressure upstream the engine when the same is active. The increased air pressure is aimed at in order to obtain a more expedient filling of the cylinders of the engine when the inlet valves of the cylinders are opened upon power output, i.e., normal operation. Thereby, the air intake duct accordingly has to co-operate with some form of valve in order to shut off the air supply when the accelerator pedal is disengaged as a consequence of continued, at least temporary, power output from the engine not being desired, for instance when the gearing from the engine is to be changed. In previously known combustion air supply arrangements, this valve has usually been located in one of two locations, either upstream the compressor or downstream the compressor. Furthermore, a plurality of variants and types of compressors are commercially available and the choice of compressor may affect the location of said valve. For instance, it may be mentioned that if a displacement compressor of screw-compressor type is used, the valve should absolutely be located upstream the same, since the screw compressor, as a consequence of the strength thereof, runs the risk of overloading other components unless the air supply to the compressor being restrained. In addition, however, a screw compressor runs harder when it operates in negative pressure, which entails a strong generation of heat in the system. For a compressor of, for instance, reciprocating-compressor type or centrifugal-compressor type, it does not generally matter if the valve is located upstream or downstream the same.

A troublesome disadvantage of placing the valve downstream the compressor is that, when the accelerator control is released, the compressor continues to suck in air and compress the same. The pressure increases and, furthermore, also the temperature of the air increases. The increasing air pressure downstream the compressor runs the risk of damaging other parts and details in the system, and in order to decrease the air pressure, a bypass line or duct is introduced into the system, which line extends from a position downstream to a position upstream the compressor, so that the air pressure downstream the compressor does not just continue to increase and increase. In spite of the air circulating through the compressor, through the bypass duct and once again through the compressor, the disadvantage remains that the pressure successively increases, although at a lower rate. This increased pressure, which is thrown out by a great force when the valve is opened, may be harmful to parts included in the engine.

In addition, yet a drawback arises when the valve is closed, more precisely in that the air is heated somewhat each time the same passes the compressor and accordingly is fed by energy. Supply of hot air into the cylinders of the engine when the valve once again is opened is not preferable, on the contrary, cold air is desired that has higher density, which gives an increased filling ratio and improved combustion of the fuel-air mixture in the cylinders of the engine.

In order to lower the temperature of the air, according to conventional methods, a charge-air cooler or intercooler is used, which is situated downstream the compressor and upstream the bypass duct. The charge-air cooler entails that the temperature of the air that has passed the compressor is lowered in the same before the air is recirculated through the bypass duct. In this way, a more advantageous temperature is obtained, but the charge-air cooler is strained to an unnecessary extent, whereupon its own temperature rises, which shortens the service life and which furthermore has a negative effect on the cooling capacity of the charge-air cooler when the valve is opened upon another step on the gas.

If the valve instead is located upstream the compressor, on one hand, no bypass duct is needed, but if the system, on the other hand, in addition comprises a charge-air cooler, other troublesome problems arise. When the valve closes as a consequence of the accelerator control being released, soon a negative pressure arises in the system between the valve and the engine, i.e., in the part of the system where the compressor and the charge-air cooler are located. When the valve is opened upon another step on the gas, the desired direct response from the engine does not occur, since first the pressure has to be built up in the entire system before the desired effect is obtained. That is, the system in general and the charge-air cooler in particular act as a lagging bellows, which entails that as small a charge-air cooler as possible is demanded, but with the disadvantage that with decreasing size of the charge-air cooler, also the cooling capacity decreases in normal operation.

OBJECTS AND FEATURES OF THE INVENTION

The present invention aims at reducing or obviating the above-mentioned disadvantages of previously known combustion air supply arrangements and presenting an improved solution. A primary object is to present an air intake duct that provides a more efficient and more adapted air pressure when the valve once again is opened after having been closed a longer or shorter time. A second object is to present a combustion air supply arrangement that allows a predetermined initial pressure to be built up when the throttle that is situated downstream the compressor is closed, without having to recirculate the air. An additional object is to provide a combustion air supply arrangement that creates less stress to the engine and the parts included therein. In addition, it is an object to provide a combustion air supply arrangement that without consequential problems can have a charge-air cooler large enough to achieve the desired temperature of the air. It is also an object to provide a combustion air supply arrangement that delivers air having the desired temperature to the engine independently of how long the air supply to the engine has been shut off.

The invention relates to a combustion air supply arrangement of the type defined by way of introduction, which is characterized in that the compressor is a centrifugal compressor, the rotational speed of which is directly dependent on the rotational speed of the internal combustion engine, and that the combustion air supply arrangement is arranged in such a way that the sucked-in air is compressed once between the second throttle and the internal combustion engine. At least the primary object is attained by this combustion air supply arrangement according to the invention. The combustion air supply arrangement is substantially arranged in the above-mentioned way in order to control the amount of compressed air that is created upon, for instance, the change of gearing from the engine. Preferably, the combustion air supply arrangement is arranged in such a way that the second throttle has an adjustable degree of closing.

Preferred embodiments of the combustion air supply arrangement according to the invention are further seen in the claim or claims.

Additional advantages and features of the invention are seen in the following, detailed description of preferred embodiments.

BRIEF DESCRIPTION OF THE APPENDED DRAWINGS

Figure 2:
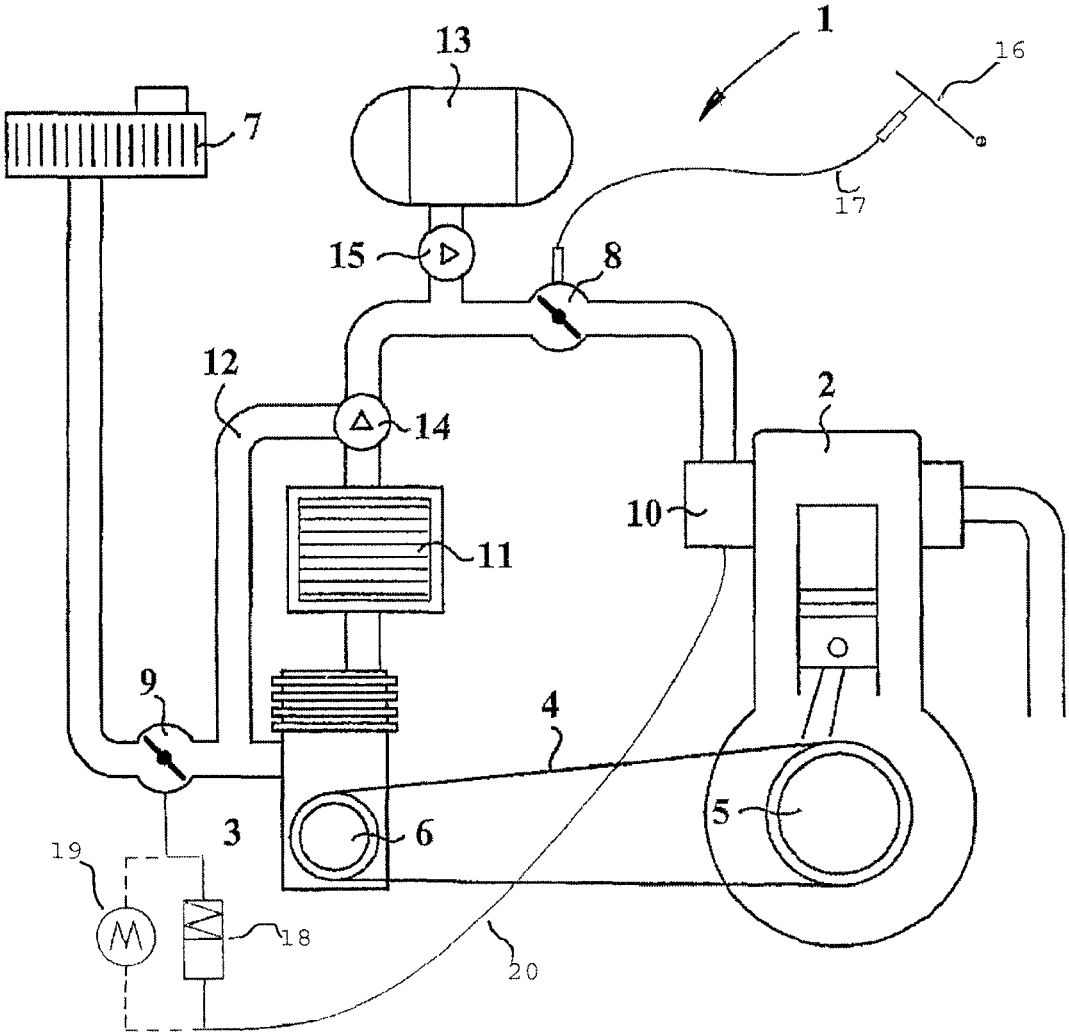

Hereinafter, the invention will be described, for exemplifying purposes, reference being made to the accompanying drawings, in which:

FIG. 1 is a schematic illustration of a combustion air supply arrangement according to the invention together with a co-operating internal combustion engine, and FIG. 2 is a schematic illustration of an alternative embodiment of the combustion air supply arrangement according to the invention together with a co-operating internal combustion engine.

DETAILED DESCRIPTION OF PREFERRED EMBODIMENTS

In FIG. 1, a combustion air supply arrangement is shown in a schematic and stripped way comprising an air intake duct, generally designated 1, connected to a co-operating motor 2, which through said air intake duct 1 receives air for the combustion of fuel in the cylinders of the same. Thus, the motor 2 is an internal combustion engine and, preferably, a petrol-powered one. It should be pointed out that by combustion air supply arrangement, herein reference is made jointly to all the components that co-operate with each other, which are located upstream the cylinders of the engine 2 and which together provide the engine 2 with air, which is intended for the combustion of fuel. That is, the invention may be said to relate to a combustion air supply arrangement that comprises an air intake duct 1 of a combustion chamber of an internal combustion engine 2 as well as a plurality of components arranged in or adjacent to the air intake duct 1. It may also be said to relate to an internal combustion engine 2 including the appurtenant air intake duct 1 and said components. In said air intake duct 1, or air intake system, a compressor 3 is arranged in the usual way, in order to build up a positive pressure such that the cylinders of the engine are filled in a fast and efficient way. In a preferred embodiment, the rotational speed of the compressor 3 is controlled by the rotational speed of the engine 2 and most preferably mechanically via a belt 4 or the like, which runs between a first pulley 5 connected to the crankshaft (not shown) of the engine 2 and a second pulley 6, which in turn in a suitable way is connected to blades (not shown) comprised in the compressor 3. The compressor 3 is preferably a displacement compressor of reciprocating-compressor type or centrifugal-compressor type. Furthermore, it is customary to provide the combustion air supply arrangement with an air filter 7 in order to filter off particles from the air that is sucked in, which particles may be harmful to the other components included in the system.

The air intake duct 1 according to the present invention comprises a first throttle 8, which is located downstream the compressor 3, as well as a second throttle 9, which in turn is located upstream the compressor 3. The purpose of the throttles 8, 9 is to change the flow area of the air intake duct 1 in the usual way. By flow area, herein reference is made to the part area of the air intake duct through which air may be allowed to pass. Thus, the throttles 8, 9 may change the flow area from being 100% of the air intake duct to 0%, i.e., that the air intake duct 1 is entirely open or entirely closed. The first throttle 8 is operatively connected to an accelerator control co-operating with the engine 2 and for instance and hereinafter referred to as an accelerator pedal 16 in a vehicle. In a preferred embodiment, the first throttle 8 is mechanically connected to the accelerator pedal 16 via a wire 17 more precisely in such a way that when the accelerator pedal 16 is disengaged, the first throttle 8 closes the air intake duct 1 between the compressor 3 and the engine 2. As a consequence of the first throttle 8 having closed the air intake duct 1 upstream the engine 2, a negative pressure arises between the first throttle 8 and the inlet valves of the engine 2. The negative pressure actuates a pressure-sensible device 10, which is operatively connected to the second throttle 9. Preferably, the pressure-sensible device 10 is mechanically connected to the second throttle 9. For instance, the pressure-sensible device 10 may consist of a nipple, on which a thin air hose 20 is arranged, which in turn extends to the second throttle 9, whereupon a negative pressure in the tube allows the, for instance spring-biased 18, second throttle 9 to close the air intake duct 1 upstream the compressor 3. The pressure-sensible device 10 may also consist of a pressure sensor 19, which is electrically connected to the second throttle 9, more precisely in such a way that when a predetermined pressure level is not reached in the air intake duct 1 at the pressure sensor, a signal is sent, directly or via an electronic control unit (not shown), to the second throttle 9 to shut the air intake duct 1 upstream the compressor 3.

When the second throttle 9 has closed the air intake duct 1 upstream the compressor 3, the pressure that was present between the throttles 8, 9 is retained. During the extremely short time window that arises from when the first throttle 8 was closed until the second throttle 9 is closed, a small positive pressure has time to be created in the part of the air intake duct 1 that the compressor 3 is located in. This limited but still notable pressure increase is of advantage when another step on the gas is given. More precisely, by the fact that when a step on the gas is given once again, the first throttle 8 opens first, whereupon a pressure increase occurs in the part of the air intake duct 1 where the pressure sensible device 10 is located. This pressure increase entails in turn that also the second throttle 9 is opened and desired power output can be obtained from the engine 2 until the accelerator pedal 16 once again is disengaged.

Preferably, the degree of closing of the second throttle 9 is variable, more precisely in such a way that when the first throttle 8 is closed, a predetermined pressure can be built up upstream the first throttle 8 by means of the compressor 3 by not allowing the second throttle 9 to close the air intake duct 1 entirely upstream the compressor 3. The degree of closing of the second throttle 9 may, for instance, be fixed and mechanically limited by means of a setting member, for instance in the form of a set screw (not shown), which prevents complete closure. Alternatively, the degree of closing of the second throttle 9 may, for instance, be adjustable based on time and/or adjustable based on how great pressure that has been obtained between the throttles 8, 9.

Furthermore, the degree of opening of the two throttles 8, 9 may also be variable in a similar way in order to additionally optimise the pressure in the system in general and at the inlet valves of the engine 2 in particular. It should be mentioned that the second throttle 9 preferably should be located near or in direct connection to the compressor 3.

Now reference is made to FIG. 2, in which a schematic, although more equipped, alternative embodiment of the combustion air supply arrangement according to the present invention is shown. Apart from what has been mentioned in connection with FIG. 1, the combustion air supply arrangement comprises, downstream the compressor 3 but upstream the first throttle 8, for instance, a charge-air cooler or intercooler 11, a bypass duct 12 and a pressure tank 13. However, it should be pointed out that of these components, one or more could be comprised, independently of each other.

According to conventional methods, the purpose of the charge-air cooler 11 is, if necessary, to lower the temperature of the air that leaves the compressor 3 and that is intended to fill the cylinders of the engine 2 when the inlet valves of the same are opened in connection with a step on the gas. An optimum temperature of the air entails better filling ratio of the cylinders as well as a more complete combustion, and thereby smaller quantity of harmful combustion gases that leave the engine 2, after completed combustion cycle. Thanks to the existence of a first throttle 8 downstream the compressor 3 and the charge-air cooler 11 as well as a second throttle 9 upstream the compressor 3 and charge-air cooler 12, during a normal state when the throttles 8, 9 are closed, no drastically increasing quantity of air will be compressed and pressurized. In combustion air supply arrangements according to prior art, the amount of circulating air increases, which entails increasing pressure and temperature in the system, which in turn entails that the charge-air cooler has to work even more when there is no power output from the engine 2. On the contrary, a possibility for the charge-air cooler 11 arises, in the combustion air supply arrangement according to the present invention, to recover and lower its own temperature when the throttles 8, 9 are closed. By means of the positive result directly following therefrom, that when the throttles once again are opened, by a wide margin there is sufficient cooling capacity in the charge-air cooler 11. This in turn entails that the size of the charge-air cooler 11 not necessarily has to be minimized to the ultimate pain threshold, but may, on the contrary, be formed precisely as large as desirable be in order to bring about optimum cooling of the air.

Furthermore, a larger charge-air cooler 11 gives the advantage that if the first throttle 8 is closed and the second throttle 9 is closed just partly, a predetermined pressure can be built up in the system between the throttles 8, 9. Here, accordingly the charge-air cooler 11 can also work as an "air tank", in which the desired positive pressure is stored to be used subsequently when the first throttle 8 is opened and before the second throttle 9 has had time to be opened.

Furthermore, the combustion air supply arrangement may, as has been mentioned above, comprise a bypass duct 12, which mouths downstream the charge-air cooler 11 and upstream the compressor 3, and which in turn comprises a valve 14, which is controlled in a suitable way. The bypass duct 12 may also be arranged in such a way that the same mouths between the charge-air cooler 11 and the compressor 3 as well as upstream the compressor 3. It should be pointed out that if a screw compressor is used, it is an indispensable requirement that a bypass duct 12 is arranged from a position downstream to a position upstream the same, otherwise a very strong heat build-up is obtained. For instance, the valve 14 may be arranged to open the bypass duct 12 as a consequence of a negative pressure arising at the above-mentioned pressure-sensible device 10. For instance, the valve 14 may be opened in a way corresponding to the closure of the second throttle 9, which has been described above. Above all, the purpose of the bypass duct 12 is to act as a safety device, more precisely by being opened if, for instance, the second throttle 9 is not closed as meant. If the first throttle 8 is closed but not the second throttle 9, the air that is compressed in the compressor 3 has to escape somewhere, and on that occasion the bypass duct 12 works as according to prior art, i.e., that the air is circulated, accordingly the engine 2 and the air intake duct 1 can continue to be used until they are left for service and the malfunction is fixed.

The possibly comprised pressure tank 13 has the purpose of storing the air pressure that arises from the closure of the first throttle 8 until the closure of the second throttle 9, such as has been described above, to subsequently release the same pressure upon another step on the gas and in this way obtain quick response from the engine 2. Preferably, the pressure tank 13 is provided with a valve 15, which is controlled in a suitable way in order to optimally make use of the pressure peak that is formed upon the closing procedure of the throttles 8, 9.

The great advantage attained by the combustion air supply arrangement according to the invention is that optimal air pressure up to the cylinders of the engine 2 is obtained in direct connection with another step on the gas, at the same time as the temperature of the air is exceptionally more optimal in relation to the air temperature in systems according to prior art. Furthermore, a more optimal size of the charge-air cooler 11 can be chosen, which operates at lower temperature and hence gets a longer service life. Furthermore, the compressor 3 will, when the accelerator pedal is disengaged, rotate easier in the optimal air pressure, which requires less quantity of energy in relation to systems having only one throttle located downstream the compressor. A great advantage is also that an optimal precharge of the air can be obtained without any form of recirculation in the system.

FEASIBLE MODIFICATIONS OF THE INVENTION

The invention is not only limited to the embodiments described above and shown in the drawings. Thus, the air intake duct may be modified in miscellaneous ways within the scope of the subsequent claims. Especially, it should be mentioned, that in spite of the first and second throttles preferably being mechanically controlled, they may also be controlled pneumatically, hydraulically, electrically or in another similar way. It should also be pointed out that by the expression throttle, which for the sake of simplicity has been used both in the claims and in the detailed description, conventional throttles are not necessarily meant, but all valves, air chokes and throttle valves that have the capacity of regulating the throughput of air in a duct should be regarded as included. More precisely, the term throttle should be interpreted in the widest sense thereof. The invention is applicable to engine-driven units and vehicles in general and road-certified Vehicles in particular. The first throttle, or the valve means, may advantageously be located in the direct vicinity of the inlet valves of the engine or even consist of the same. In addition, it should be mentioned that all valves, throttles and other possible movable parts in the combustion air supply arrangement according to the invention can be controlled mechanically, hydraulically, pneumatically, electronically or in a similar way. It should further be realized that each throttle may consist of one or more valve elements and that the second throttle not necessarily has to be controlled as a consequence of the first throttle having closed, but possibly on the same signal as the first throttle closes.

It should also be pointed out that by the feature "the rotational speed of the centrifugal compressor is directly dependent on the rotational speed of the internal combustion engine", it is intended that if the internal combustion engine is in operation, also the centrifugal compressor is in operation, for instance via a belt or the like or via a variator or the like. Furthermore, it should be pointed out that by the feature, "the sucked-in air is compressed once between the second throttle and the internal combustion engine", it is intended that no circulation of the combustion air occurs, i.e., this is a positive circumlocution of the negative feature that the combustion air supply arrangement does not comprise a bypass duct or a similar construction to bring back already compressed air to a location upstream the compressor for further compression.

The invention claimed is:

1. A combustion air supply arrangement comprising:

an air intake duct (1) of an internal combustion engine (2), said air intake duct (1) comprising:

a compressor (3) the rotational speed of which is directly dependent on the rotational speed of the internal combustion engine (2);

a first throttle (8) located between the compressor (3) and the internal combustion engine (2) and arranged to change the flow area of said air intake duct (1) between the compressor (3) and the internal combustion engine (2) in response to the operation of a gas pedal; and a second throttle (9) which is located upstream the compressor (3) and arranged to change the flow area of the air intake duct (1) upstream the compressor (3) in response to a pressure detected by a pressure sensing device (10) located in the air intake duct between the first throttle (8) and the engine (2), wherein the second throttle (9) upstream of the compressor (3) is closed in consequence of a negative pressure detected in the air intake duct (1) resulting from closing the first throttle (8) downstream of the compressor (3) upon release of the gas pedal, and wherein in the closed modes of the first (8) and second (9) throttles air at super-charged pressure is stored in an air pressure storage tank (13) arranged to communicate with the air intake duct (1) via a valve (15) arranged downstream of the compressor and upstream of the first throttle (8).

2. The combustion air supply arrangement of claim 1, wherein the valve (15) is controllable for storing air in the air pressure tank (13) upon release of the gas pedal, and for releasing air from the air pressure tank (13) upon down-pressing the gas pedal.

3. The combustion air supply arrangement of claim 2, wherein in the closed modes of the first (8) and second (9) throttles air is re-circulated through the compressor (3) via a by-pass duct (12) connecting to the air intake duct (1) downstream of the compressor and upstream of the compressor, between the compressor (3) and the second throttle (9).

4. The combustion air supply arrangement according to claim 3, wherein a valve (14) in the air intake duct (1) is controllable to open for flow into the by-pass duct (12) in response to a pressure detected by the pressure sensing device (10).

5. The combustion air supply arrangement according to claim 4, wherein a charge-air cooler (11) is arranged in the air intake duct (1) between the compressor (3) and the valve (14) into the by-pass duct (12).

6. The combustion air supply arrangement according to claim 3, wherein a valve (14) in the air intake duct (1) is controllable to open for flow into the by-pass duct (12) in response to the position of the second throttle (9).

7. The combustion air supply arrangement according to claim 6, wherein a charge-air cooler (11) is arranged in the air intake duct (1) between the compressor (3) and the valve (14) into the by-pass duct (12).

8. The combustion air supply arrangement according to claim 1, wherein the second throttle (9) has adjustable degree of closing.

9. The combustion air supply arrangement according to claim 1, wherein the second throttle (9) is a mechanically controlled throttle.

10. The combustion air supply arrangement according to claim 1, wherein the second throttle (9) is an air-pressure controlled throttle.

* * * * *